United States Patent [19]

Harada et al.

[11] 4,207,430

[45] Jun. 10, 1980

[54] OPTICAL MOTIONAL FEEDBACK

[75] Inventors: Masaki Harada, Yao; Tokuhiro Mikami, Yawata, both of Japan

[73] Assignee: U.S. Philips Corporation, New York, N.Y.

[21] Appl. No.: 970,408

[22] Filed: Dec. 18, 1978

[30] Foreign Application Priority Data

Jan. 27, 1978 [GB] United Kingdom ..... 3372/78

[51] Int. Cl.[2] ..... H04R 3/00

[52] U.S. Cl. ..... 179/1 F

[58] Field of Search ..... 179/1 F

*Primary Examiner*—George G. Stellar

*Attorney, Agent, or Firm*—Thomas A. Briody; William J. Streeter; Bernard Franzblau

[57] ABSTRACT

An electrodynamic loudspeaker which comprises a diaphragm which cooperates with a magnet system by means of a moving coil which is connected to said diaphragm and an optical measuring system which comprises two elements—a light source and a detector. At least one of said elements is connected to a central portion of the magnet system and the detector supplies a voltage which substantially corresponds to the displacement of the diaphragm. The other element is connected to the diaphragm and the magnet system is provided with a channel which is disposed in the direct path between the two elements.

In order to linearize the luminous intensity characteristic, in accordance with a preferred embodiment, the channel is filled with an optical fibre material. Light weight LED's and phototransistors may be used as the optical elements.

9 Claims, 3 Drawing Figures

OPTICAL MOTIONAL FEEDBACK

Figure 1:
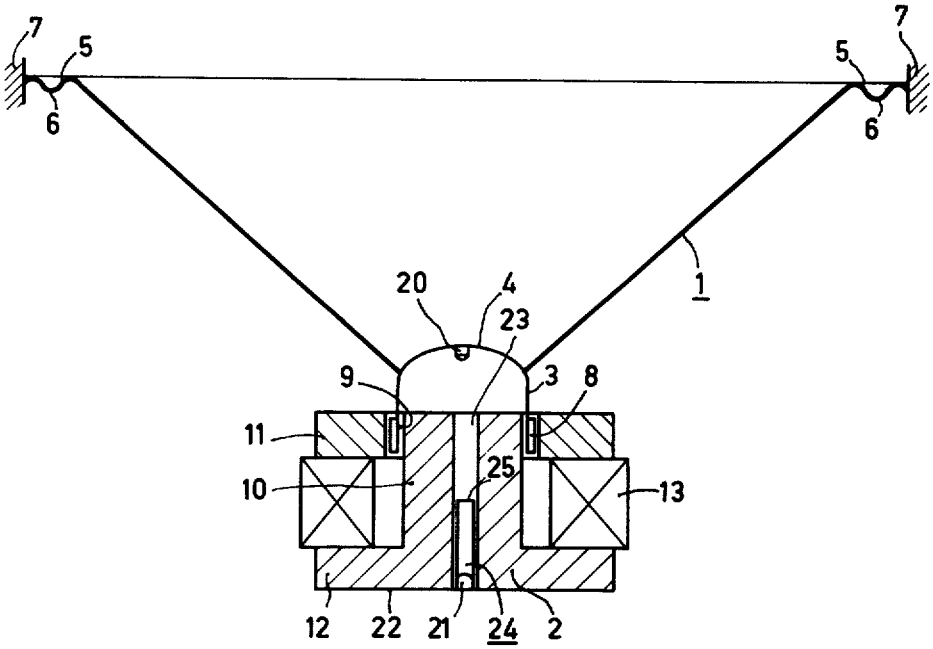

The invention relates to an electrodynamic loudspeaker which comprises a diaphragm which cooperates with a magnet system by means of a moving coil which is connected to said diaphragm, an optical measuring system which comprises two elements—a light source and a detector—at least one of said elements being connected to a central portion of the magnet system, and the detector supplying a voltage which substantially corresponds to the displacement of the diaphragm.

Such a so-called "Optical Motional Feedback" loudspeaker is known from the published French Patent Application 75 000 11 (publication no. 2,296,985).

According to this Application the two elements—i.e. the light source and the detector—are mounted on the top of the central core of the magnet system by means of an intricate construction. The coil former is provided with an extension in which a triangular cut-out is disposed in the light beam between the two elements. The light beam is modulated by the movement of the diaphragm, which movement is transmitted to the coil former. The signal supplied by the detector is fed back to the input of the audio amplifier associated with the loudspeaker after having passed through various correction networks.

Since motional feedback is almost exclusively used for a frequency range below 500 Hz, the excursion of the coil former at very low frequencies can be of the order of magnitude of a few millimetres for a 10-inch loudspeaker.

In order to enable this large excursion to be processed optically, Japanese Utility Model, Patent No. 42-15110, has proposed a construction in which the two elements are disposed adjacent each other in front of the diaphragm in a fixed position. The dust cap is provided with a mirror which reflects the light beam from the light source to the detector so that the light beam is thus modulated.

However, this construction has the disadvantage that it constitutes an acoustic obstacle for the sound being reproduced.

The invention is characterized in that the other element is connected to the diaphragm, and the magnet system is provided with a channel which is disposed in the direct path between the two elements.

In the central core of existing loudspeaker types a channel is formed. When the optical elements are constituted by a LED (light emitted diode) as a light source and a photo-transistor as a detector—these elements are now of very small dimensions and very light in weight—the weight of the diaphragm is hardly influenced by securing one of said elements to the diaphragm.

The other element may be mounted both inside and underneath the channel.

Furthermore, the invention is base on the following concepts.

It is known that the luminous intensity as a function of the distance between the light source and the detector has a substantially hyperbolic character, the luminous intensity up to a specific distance being substantially constant at very small distances. A graphic representation of this function first exhibits a substantially horizontal portion, which readily changes into a hyperbola.

It is obvious that the operating point is to be selected so that it is situated on a substantially linear portion of the curve.

For an excursion of a few millimeters—as previously stated—a non-linear detection signal may then be produced.

In order to substantially reduce the resulting non-linear distortion, a part of the channel is filled with an optical fibre material in accordance with a suitable embodiment of the invention.

Numerous tests have revealed that when acrylic resin is used as a fibre material and the inner wall of the channel is matted, a luminous intensity curve can be obtained which has such a linear portion that the resultant detection signal exhibits a negligible distortion.

The channel may be disposed axially and centrally in the central core of the magnet system and is provided with an insert at the end which is remote from the diaphragm, which insert consists of an internally matted tube which is partly filled with an optical fibre material and which insert is provided with a phototransistor at the rear, while the LED is secured to the central portion of the diaphragm.

In this respect it is favourable to mount this light source at the inside of the dust cap, with which most loudspeakers are provided, in the central portion of the diaphragm.

It is evident that apart from a phototransistor other semiconductor detectors, for example photo-diodes or photo resistors, may be employed.

Figure 2:
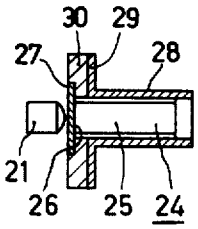
Figure 3:
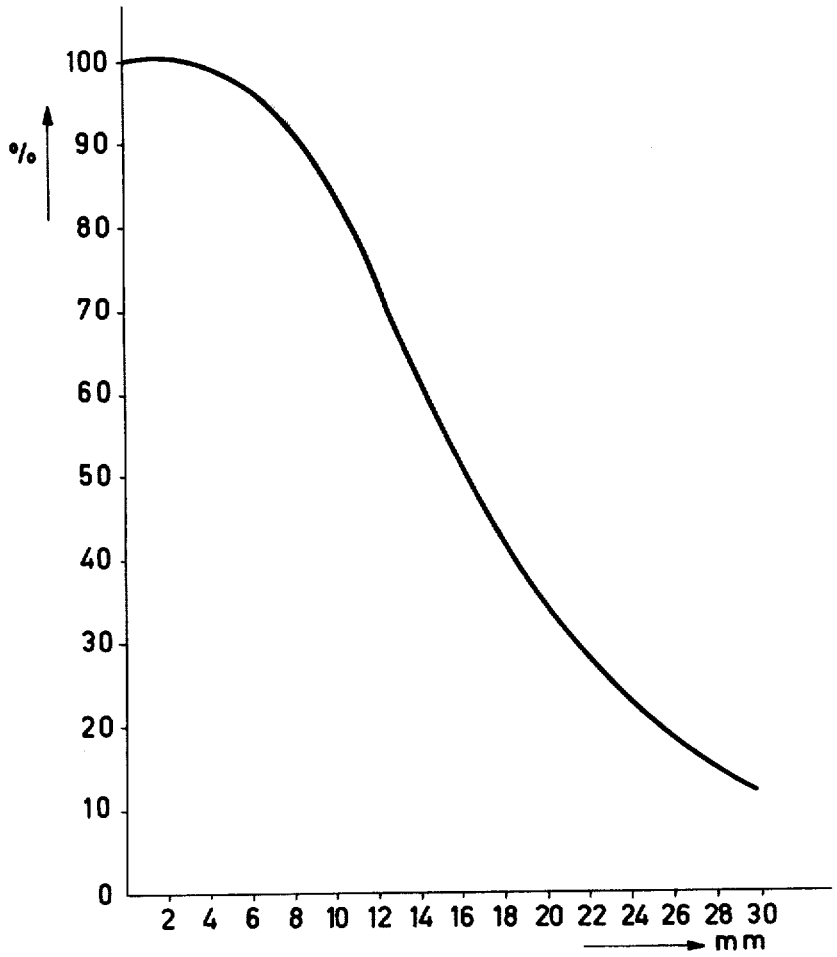

The invention will now be described in more detail with reference to the drawing in which:

FIG. 1 schematically shows a cross-section of a loudspeaker embodying the invention, whose central core is provided with a channel, FIG. 2 is a detailed diagram of the insert embodying the invention, and FIG. 3 graphically represents the luminous intensity as a function of the distance for the loudspeaker in accordance with FIGS. 1 and 2.

FIG. 1 schematically shows a cross-section of an electro-dynamic bass loudspeaker embodying the invention. This loudspeaker comprises a movable part: the diaphragm 1 and a stationary part: the magnet system 2.

The diaphragm 1 is cone-shaped and essentially consists of impregnated paper. The central portion of the diaphragm is connected to a coil former 3 and to a dust cap 4, which dust cap covers the coil former completely. The diaphragm 1 is secured to a schematically shown rigid suspension 7—generally a support of the cone, which is connected to the magnet system 2 on the other side—at its upper edge 5 via a flexible rubber rim 6.

The coil former 3 is provided with a loudspeaker coil 8, which in the rest position is symmetrically disposed in the effective air gap 9 of the magnet system 2. This air gap 9 is constituted by the central soft-iron core 10 and the soft-iron top plate 11.

The core 10 is integral with the soft-iron bottom plate 12. An angular permanent magnet 13 is enclosed between the top plate 11 and the bottom plate 12. This permanent magnet is made of an oxide-ceramic material.

A magnet system of this construction produces a radially homogeneous magnetic field in the air gap 9, which field cooperates with the loudspeaker coil 8.

Since this loudspeaker gives rise to distortion in the form of second and third harmonics for frequencies lower than 500 Hz owing to the inertia and the conicity of the diaphragm, which distortion increases as the frequency decreases, it is desirable to monitor the movement of the diaphragm with a measuring system. This measuring system supplies a voltage which, after various electronic processing steps in a negative feedback circuit, is fed back to the input of the audio amplifier to which the loudspeaker is connected.

Such a measuring system may for example consist of a piezo-electric transducer (see the article by Ernst Pfau on Motional Feedback in Funkschau, 1973, 18, pages 691–693). A disadvantage of this approach is that the weight of the diaphragm substantially increases by mounting said transducer together with the impedance transformer.

Owing to the miniaturization of the light sources in the form of LED's and the phototransistors cooperating therewith, which are very light-weight elements, an optical system is particularly suitable for the above-mentioned measuring system. This optical system is incorporated in the loudspeaker in accordance with FIG. 1.

At the inside of the dust cap 4 a LED (light emitted diode) is centrally mounted as the light source 20. As detector a phototransistor 21 is used, which is also centrally mounted. The phototransistor 21 is disposed on the other side 22 of the bottom plate 12. In order to obtain a light path between the two optical elements a channel 23 is formed in the core 10.

On the inside this channel is matted and is provided over a part of its length with an optical guide material 24 made of acrylic resin fibres.

The luminous intensity/distance characteristic of the two optical elements 20 and 21 is influenced by the optical guide means 24 and the matted wall of the channel 23. Thus it is possible to obtain an operating point at the desired location in a linear portion of the characteristic.

Such a characteristic is shown in FIG. 3, the relative detector current in % being plotted vertically and the distance in mm between the end 25 of the optical guide means 24 and the LED 20 being plotted horizontally.

The relative detector current is to be understood to mean the ratio of the actual detector current to said current at a distance of 0 mm.

This characteristic is found to have a substantially linear portion between 8 and 18 mm. Therefore the operating point is to be situated between 12 and 14 mm.

FIG. 2 shows the optical guide 24 in the form of an insert, which consists of a rod of a fibre material 25, which is secured to a thin glass disc 27 at an end 26.

The rod 25 is disposed in a brass tube 28 which has a flange 29. Said tube 28 is internally matted.

The rod 25 and tube 28 are secured to each other by means of a plastic ring 30 in such a way that the rod 25 is clear of the tube 28.

The phototransistor is disposed immediately behind the glass disc 27, which is shown schematically.

The following are some data relating to a loudspeaker which produces a characteristic in accordance with FIG. 3.

Loudspeaker type AD 7066 (Philips)
diameter of diaphragm: 150 mm
diameter of core: 25 mm
diameter of Magnadur magnet: 90 mm
height of voice coil: 11 mm
height of air gap: 5 mm
length of optical guide: 33 mm
length of dull pipe: 28 mm
Power handling capacity: 40 Watts.

What is claimed is:

1. An electrodynamic loudspeaker comprising, a magnet system, a diaphragm which cooperates with said magnet system by means of a moving coil connected to said diaphragm, an optical measuring system which comprises a light source element and a detector element, at least one of said elements being connected to a central portion of the magnet system and the other element being connected to the diaphragm, and wherein the magnet system includes a channel which is disposed in the direct path between the light source and the detector elements whereby the detector element supplies a voltage which substantially corrresponds to the displacement of the diaphragm.

2. A loudspeaker as claimed in claim 1, wherein a part of the channel is filled with an optical fibre material.

3. A loudspeaker as claimed in claim 2, wherein the optical fibre material comprises an acrylic resin.

4. A loudspeaker as claimed in claim 1, wherein the inner wall of the channel is matted.

5. A loudspeaker as claimed in claim 2, wherein the inner wall of the channel is matted.

6. A loudspeaker as claimed in claim 3, wherein the inner wall of the channel is matted.

7. A loudspeaker as claimed in any of the preceding claims, wherein the light source comprises a light emitted diode (LED) and the detector comprises a phototransistor.

8. A loudspeaker as claimed in claim 7, wherein the channel is axially and centrally disposed in the central core of the magnet system and is provided with an insert at the end which is remote from the diaphragm, which insert comprises an internally matted tube which is partly filled with an optical fibre material and which insert is provided with a phototransistor at the rear, and the LED is secured to the central portion of the diaphragm.

9. A loudspeaker as claimed in claim 8, wherein the central portion of the diaphragm comprises a dust cap, at the inside of which the LED is secured.

* * * * *